US012292251B2

(12) United States Patent
Gangl

(10) Patent No.: US 12,292,251 B2
(45) Date of Patent: May 6, 2025

(54) ADJUSTABLE GAS BLOCK FOR FIREARM

(71) Applicant: J.P. Enterprises, Inc., Hugo, MN (US)

(72) Inventor: Matthew Blake Gangl, Falcon Heights, MN (US)

(73) Assignee: J.P. Enterprises, Inc., Hugo, MN (US)

( * ) Notice: Subject to any disclaimer, the term of this patent is extended or adjusted under 35 U.S.C. 154(b) by 0 days.

(21) Appl. No.: 18/585,641

(22) Filed: Feb. 23, 2024

(65) Prior Publication Data

US 2024/0288237 A1 Aug. 29, 2024

Related U.S. Application Data

(60) Provisional application No. 63/447,782, filed on Feb. 23, 2023.

(51) Int. Cl.
*F41A 5/28* (2006.01)

(52) U.S. Cl.
CPC ..... *F41A 5/28* (2013.01)

(58) Field of Classification Search
CPC ..... F41A 5/26; F41A 5/28
See application file for complete search history.

(56) References Cited

U.S. PATENT DOCUMENTS 9,335,106 B1 * 5/2016 Simon ..... F41A 5/28
10,330,409 B2 * 6/2019 Bray ..... F41A 5/28
11,287,201 B1 3/2022 Underwood
11,994,357 B2 5/2024 Salinas
2018/0202733 A1 * 7/2018 Bray ..... F41A 5/28

* cited by examiner

*Primary Examiner* — Jonathan C Weber
(74) *Attorney, Agent, or Firm* — Wood Herron & Evans LLP

(57) ABSTRACT

An adjustable gas block for a firearm comprises a housing adapted to be attached to a barrel of the firearm. The housing has a first passageway adapted to be aligned with a gas port in a barrel of the firearm and a second passageway adapted to receive a gas tube of the firearm, such that a bore of the barrel, the gas port of the barrel, the first passageway, and the gas tube are in fluid communication. A valve member is mounted in the housing for forward and rearward sliding movement and has a first portion and a second portion. The first portion has an upwardly facing surface having a radius of curvature that closely approximates a radius of curvature of an outer diameter of the gas tube, and the second portion has threads. A nut is carried by the housing for rotational movement and has threads mating with the threads on the second portion of the valve. Rotating the nut in a first direction translates the valve member forwardly and rotating the nut in a second opposite direction translates the valve member rearwardly. The axial position of the first portion of the valve member controls the amount of gas passing from the first passageway to the gas tube by completely opening, partially opening, or completely closing the first passageway.

14 Claims, 9 Drawing Sheets

ADJUSTABLE GAS BLOCK FOR FIREARM

RELATED APPLICATIONS

This application claims the priority benefit of U.S. Provisional Patent Application No. 63/447,782 filed Feb. 23, 2023, which is hereby incorporated by reference herein as if fully set forth in its entirety.

TECHNICAL FIELD

This invention relates generally to gas blocks for gas-operated firearms, and more particularly to adjustable gas blocks for direct impingement (internal piston) AR-pattern firearms.

BACKGROUND

Gas blocks on firearms have evolved over the years from simple fixed manifolds to complex adjustable devices. Most notably, the AR platform (AR-15 rifle and carbine, M16 rifle, M4 carbine, AR-10 rifle, etc.) has developed such that adjustable gas blocks have become practically ubiquitous for highly skilled users and competitive shooters.

In addition, a variety of developments to, and aftermarket parts for, the AR platform have been introduced to the market that affect the gas block. These include new calibers in other than 5.56×45 mm, barrel contours, and hand guards of various shapes and sizes. The use of various barrel contours and hand guards has reduced the clearance for the gas block, thus driving the need for more compact gas blocks. Meanwhile, new calibers, various barrel lengths, various cartridge loads (including, but not limited to, supersonic and subsonic) and the use of sound suppressors have driven the need for greater resolution and ease of adjustability.

Current solutions for these problems generally utilize either selection between discrete port sizes or simple set screws for an adjustable valve system. This forces several design compromises. Firstly, the valve screw must fully clear the barrel and gas tube during its rotational travel. This problem is generally solved by pushing the gas tube further away from the barrel which induces unwanted stresses in the assembly. Secondly, any detent mechanism is acting on the outer diameter of the valve screw which is generally very small and only allows for a limited number of detent locations. Lastly, the screw threads and the detent are exposed to the combustion gases escaping from the barrel through the gas port which can lead to fouling and seizing of the mechanism.

Accordingly, further improvement in adjustable blocks is desired.

SUMMARY OF THE INVENTION

In one aspect, an adjustable gas block for a firearm comprises a housing adapted to be attached to a barrel of the firearm. The housing has a first passageway adapted to be aligned with a gas port in a barrel of the firearm and a second passageway adapted to receive a gas tube of the firearm, such that a bore of the barrel, the gas port of the barrel, the first passageway, and the gas tube are in fluid communication. A valve member is mounted in the housing for forward and rearward sliding movement and has a first portion and a second portion. The first portion has an upwardly facing surface having a radius of curvature that closely approximates a radius of curvature of an outer diameter of the gas tube, and the second portion has threads. A nut is mounted to the housing for rotational movement and has threads mating with the threads on the second portion of the valve member. Rotating the nut in a first direction translates the valve member forwardly and rotating the nut in a second opposite direction translates the valve member rearwardly. The axial position of the first portion of the valve member controls the amount of gas passing from the first passageway to the gas tube by completely opening, partially opening, or completely closing the first passageway.

The adjustable gas block can further include a resilient detent mounted in the housing that cooperates with the nut to provide positive engagement of the nut at a plurality of rotational positions of the nut.

The nut can include a forward portion, a rearward portion, and a central portion, the central portion having an outer diameter less than an outer diameter of the rearward portion, and the upper housing can have a recess forward of the first passageway, the recess having a forward shoulder and a rearward shoulder. The recess receives the rearward portion of the nut. A rearward surface of the rearward portion of the nut abuts the rearward shoulder of the recess to prevent rearward translation of the nut, and a forward surface of the rearward portion of the nut abuts the forward shoulder of the recess to prevent forward translation of the nut.

The forward and rearward portions of the nut can each include a plurality of longitudinally extending grooves circumferentially spaced therearound.

An axis of rotation of the nut can be positioned below a longitudinal axis of the gas tube.

The axis of rotation of the nut and the longitudinal axis of the gas tube can be spaced apart by an amount less than one half of the sum of the outer diameter of the gas tube and an outer diameter of the forward portion of the valve member.

In another aspect, a firearm comprises an action, a barrel having a bore and a gas port, a gas tube for receiving gas from the bore via the gas port and directing the gas to the action to cycle the action, and an adjustable gas block having a housing attached to the barrel. The housing has a first passageway aligned with the gas port and a second passageway receiving the gas tube, such that the bore, the gas port, the first passageway, and the gas tube are in fluid communication. A valve member is mounted in the housing for forward and rearward sliding movement and has a first portion and a second portion. The first portion has an upwardly facing surface having a radius of curvature that closely approximates a radius of curvature of an outer diameter of the gas tube, and the second portion has threads. A nut is mounted to the housing for rotational movement and has threads mating with the threads on the second portion of the valve member. Rotating the nut in a first direction translates the valve member forwardly and rotating the nut in a second opposite direction translates the valve member rearwardly. The axial position of the first portion of the valve member controls the amount of gas passing from the first passageway to the gas tube by completely opening, partially opening, or completely closing the first passageway.

In another aspect, an adjustable gas block for a firearm comprises a housing adapted to be attached to a barrel of the firearm. The housing has a first passageway adapted to be aligned with a gas port in a barrel of the firearm and a second passageway adapted to receive a gas tube of the firearm, such that a bore of the barrel, the gas port of the barrel, the first passageway, and the gas tube are in fluid communication. A valve member is mounted in the housing for forward and rearward sliding movement and has a first portion and a second portion. The second portion has threads. A nut is mounted to the upper housing for rotational movement and has threads mating with the threads on the second portion of the valve. Rotating the nut in a first direction translates the valve member forwardly and rotating the nut in a second opposite direction translates the valve member rearwardly. The axial position of the first portion of the valve member controls the amount of gas passing from the first passageway to the gas tube by completely opening, partially opening, or completely closing the first passageway. The first portion of the valve is configured such that an axis of rotation of the nut and a longitudinal axis of the gas tube are spaced apart by an amount less than one half of the sum of an outer diameter of the gas tube and an outer diameter of the second portion of the valve member.

In another aspect, a firearm comprises an action, a barrel having a bore and a gas port, a gas tube for receiving gas from the bore via the gas port and directing the gas to the action to cycle the action, and an adjustable gas block having a housing removably attached to the barrel. The housing has a first passageway aligned with the gas port and a second passageway receiving the gas tube, such that the bore, the gas port, the first passageway, and the gas tube are in fluid communication. A valve member is mounted in the housing for forward and rearward sliding movement and has a first portion and a second portion. The second portion has threads. A nut is mounted to the housing for rotational movement and has threads mating with the threads on the second portion of the valve member. Rotating the nut in a first direction translates the valve member forwardly and rotating the nut in a second opposite direction translates the valve member rearwardly. The axial position of the first portion of the valve member controls the amount of gas passing from the first passageway to the gas tube by completely opening, partially opening, or completely closing the first passageway. The first portion of the valve member is configured such that an axis of rotation of the nut and a longitudinal axis of the gas tube are spaced apart by an amount less than one half of the sum of an outer diameter of the gas tube and an outer diameter of the second portion of the valve member.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
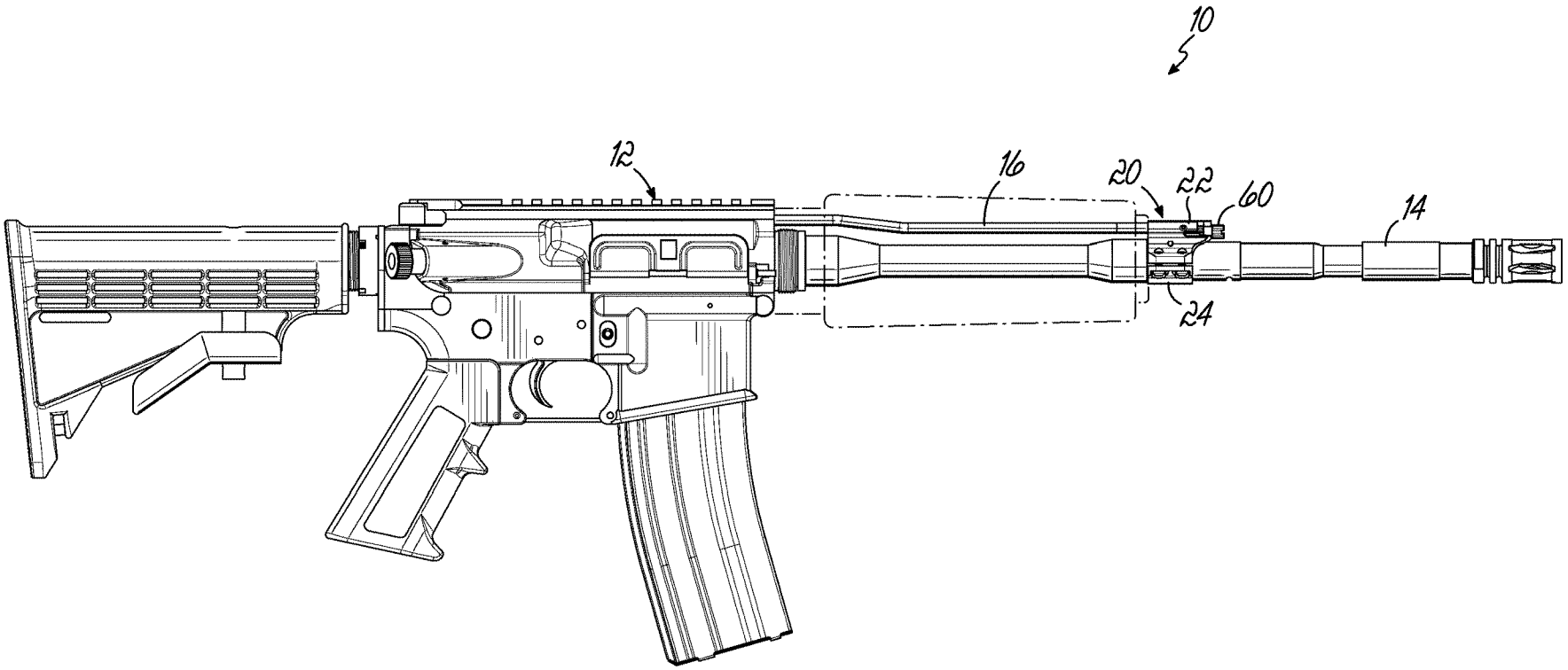
FIG. 1 is a side view of an AR15 or M4 carbine including an adjustable gas block according to the principles of the present invention.
Figure 2:
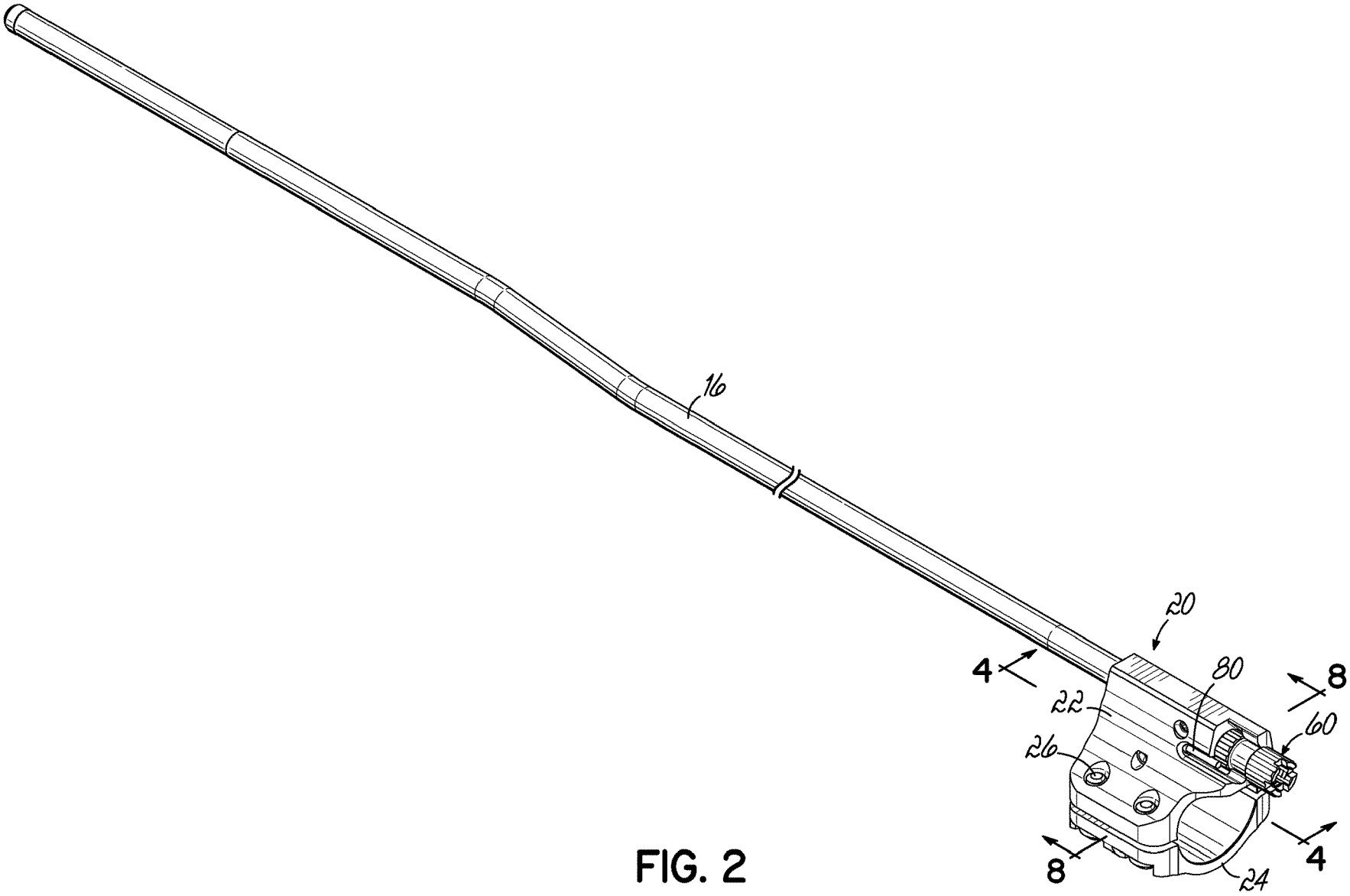
FIG. 2 is a perspective view of the adjustable gas block with a gas tube installed.
Figure 3:
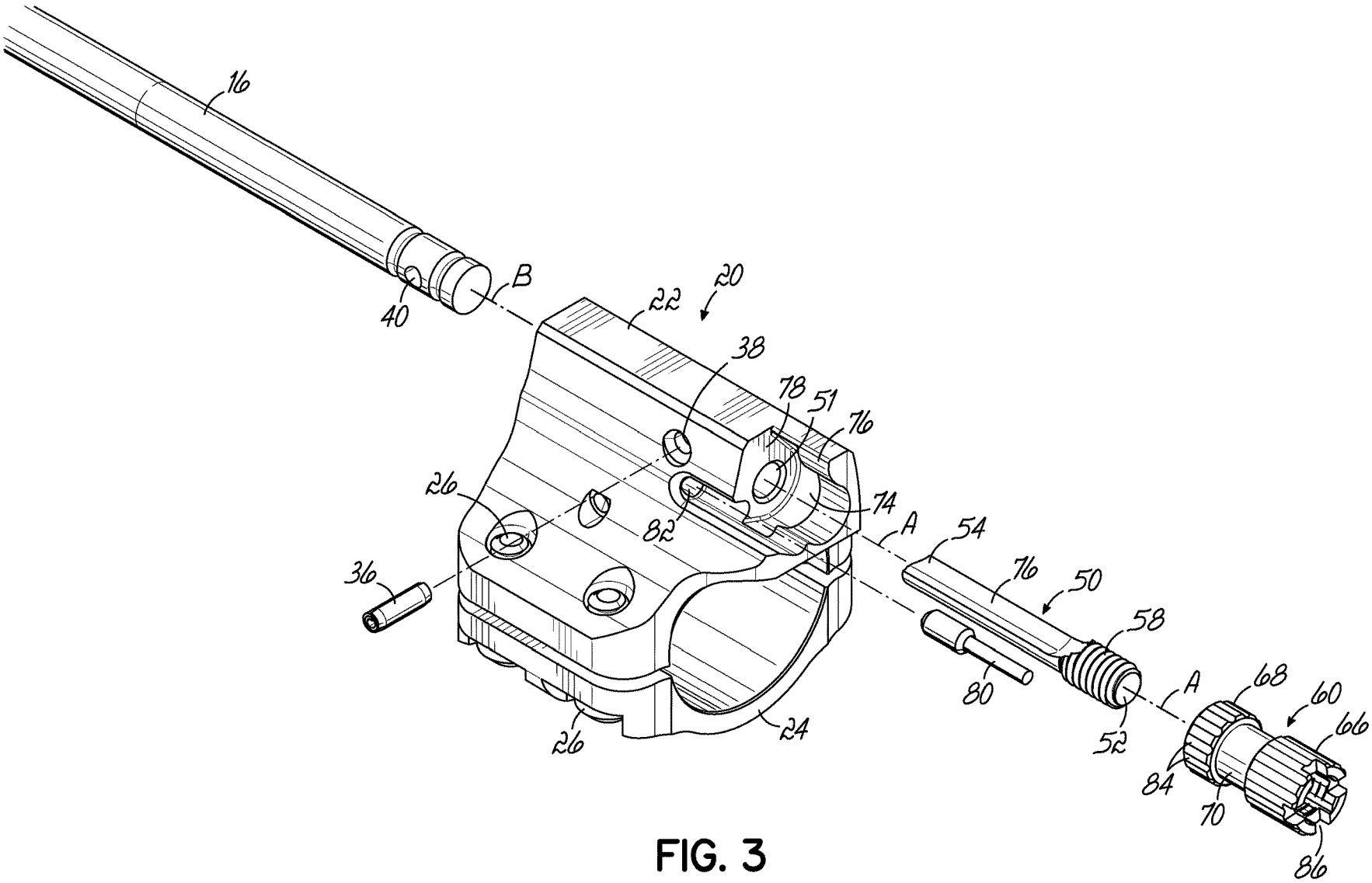
FIG. 3 is an enlarged exploded perspective view thereof.
Figure 3A:
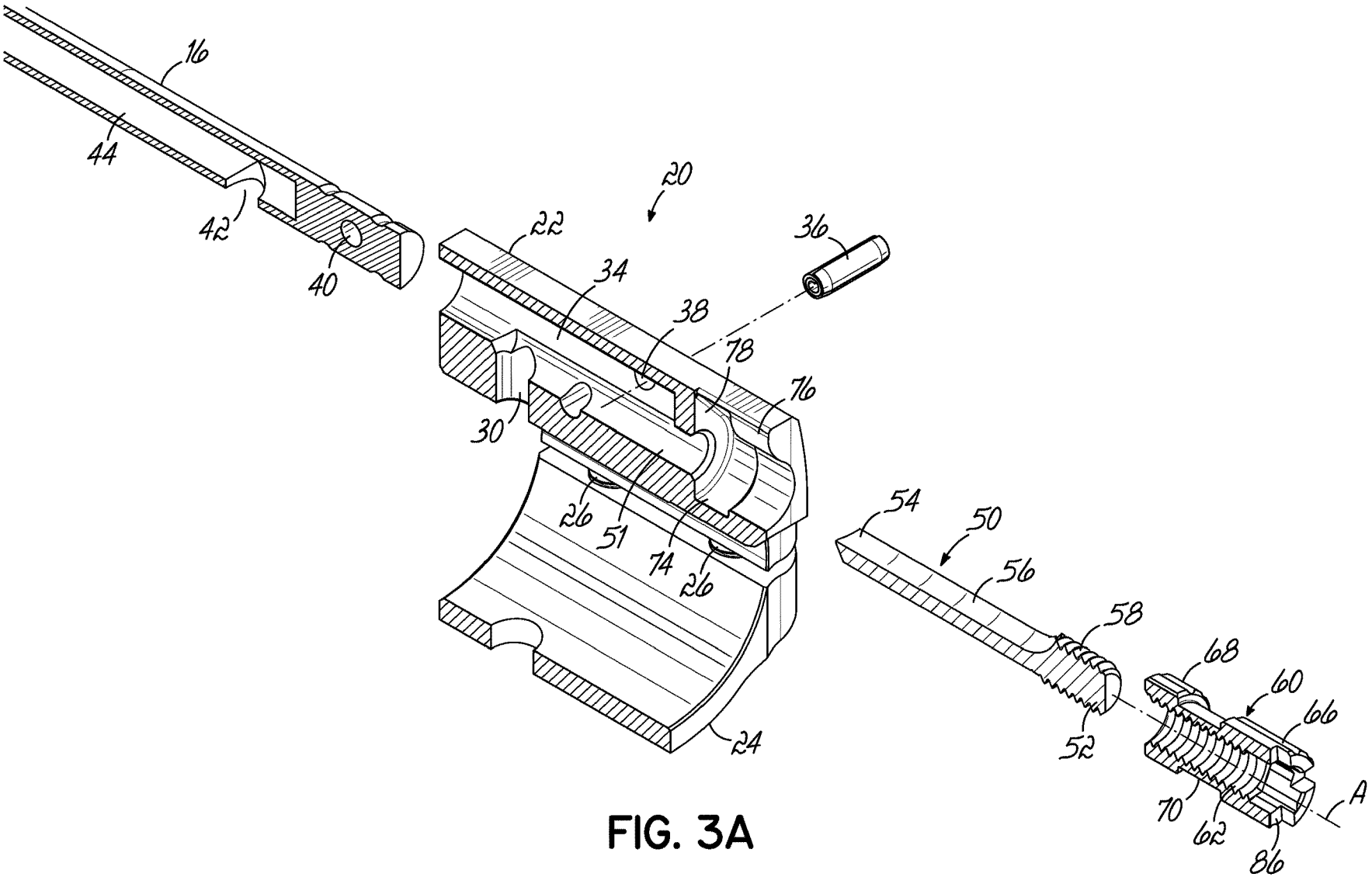
FIG. 3A is a longitudinal cross-sectional view of FIG. 3.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIG. 1, there is illustrated a standard AR-15 or M4 carbine 10 having an action 12, a barrel 14, a gas tube 16 for receiving gas from the barrel 14 and directing the gas to the action 12 to cycle the action 12, and an adjustable gas block 20 fluidically connecting the barrel 14 and the gas tube 16.

Referring to FIGS. 2-7, the adjustable gas block 20 has an upper housing 22 and a lower housing 24 removably secured to one another and hence to barrel 14 with fasteners 26. The upper housing 22 has a first passageway 30 aligned with the gas port 32 of the barrel 14. The upper housing 22 has a second passageway 34 that receives the gas tube 16. A pin 36 secures the gas tube 16 to the upper housing 22 by passing through opening 38 in the upper housing 22 and opening 40 in the gas tube 16. The gas tube 16 includes a gas passageway 44 and gas port 42 aligned with passageway 30.

A valve 50 is mounted in a cavity 51 of the upper housing 22 for forward and rearward sliding movement and has a forward portion 52 and a rearward portion 54. The rearward portion 54 has an upwardly facing surface 56. The upwardly facing surface 56 is concave and has a radius of curvature that closely approximates the radius of curvature of an outer diameter of the gas tube 16 (which of course is convex). The forward portion 52 of the valve 50 has external threads 58 thereon.

A nut 60 is mounted to the upper housing 22 for rotational movement about its longitudinal axis A and has internal threads 62 that mate with the threads 58 on the forward portion 52 of the valve 50. The nut 60 has a forward portion 66, a rearward portion 68, and a central portion 70. The central portion 70 has an outer diameter less than an outer diameter of the rearward portion 68, the purpose of which will be subsequently described.

Figure 8:
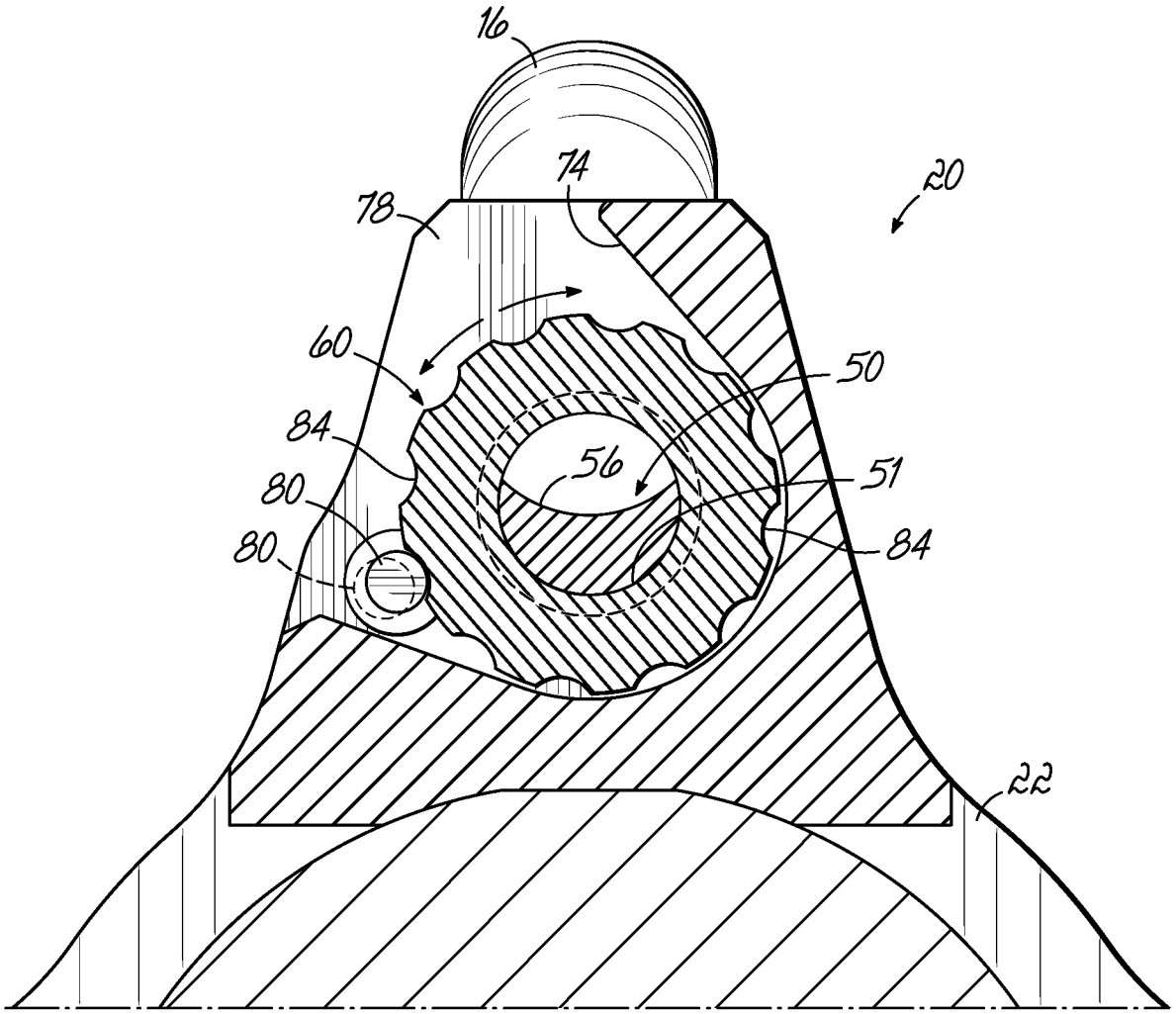
FIG. 8 is a cross-sectional view taken along line 8-8 in FIG. 1 showing the resilient detent and nut.

The upper housing 22 has a recess 74 forward of the first passageway 34. The recess 74 has a forward shoulder 76 and a rearward shoulder 78. The recess 74 receives the rearward portion 68 of the nut 60. Rotating the nut 60 in a first direction translates the valve 50 forwardly and rotating the nut 60 in a second opposite direction translates the valve 50 rearwardly. See FIGS. 4, 5, and 8. The shape of the cavity 51 in the upper housing 22 in combination with the complementary curvatures of the gas tube 16 and valve surface 56 prevents the valve 50 from rotating about the gas tube 16. A rearward surface of the rearward portion 68 of the nut 60 abuts the rearward shoulder 78 of the recess 74 thus preventing rearward translation of the nut 60, while a forward surface of the rearward portion 68 of the nut 60 abuts the forward shoulder 76 of the recess 74 thus preventing forward translation of the nut 60. Thus, nut 60, while free to rotate about its axis A, is captured as to axial translation, while valve 50, while free to translate axially, is captured as to rotation about axis A.

Figure 4:
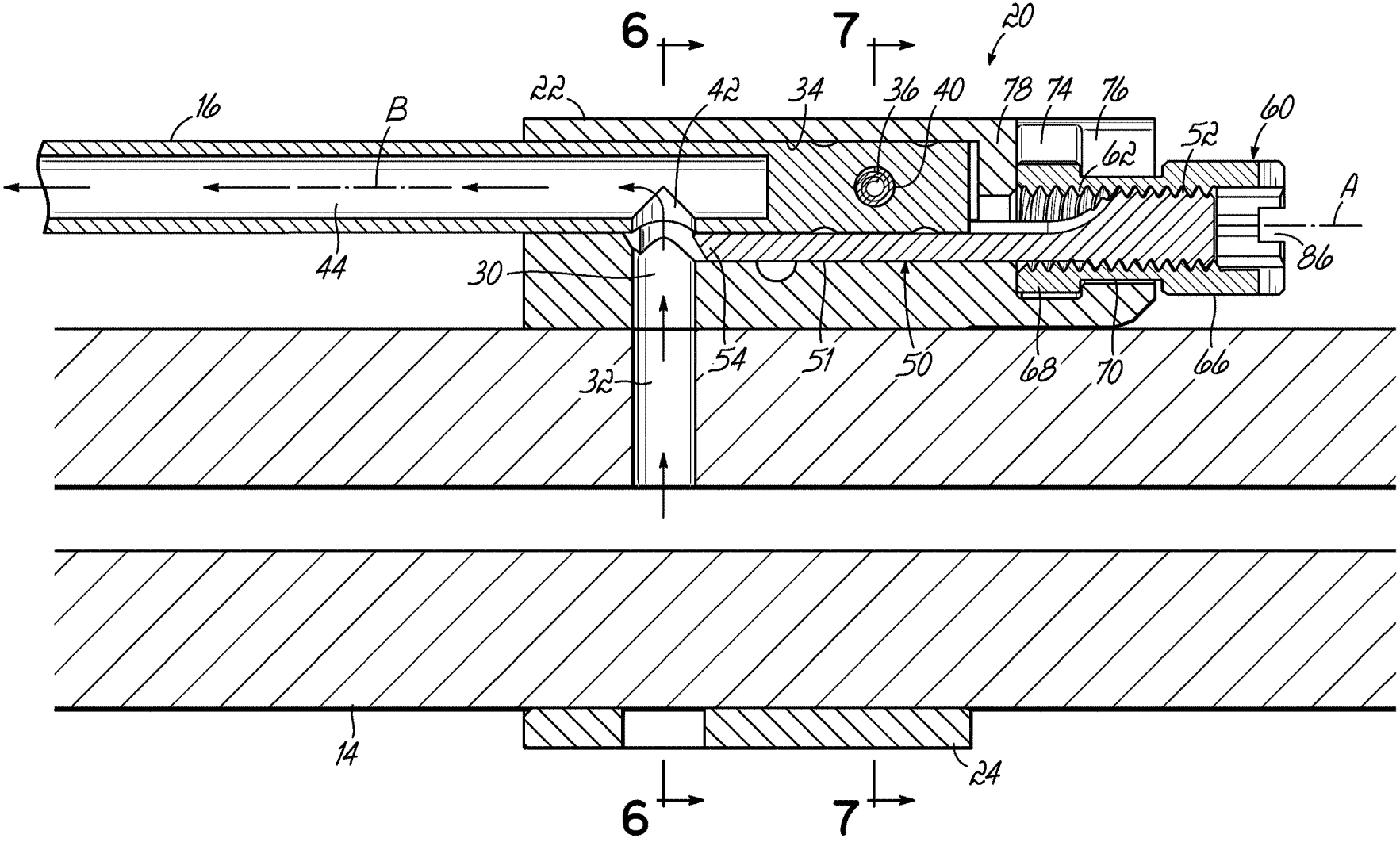
FIG. 4 is a cross-sectional view taken along line 4-4 in FIG. 2, showing the valve of the adjustable gas block in a fully open position.
Figure 5:
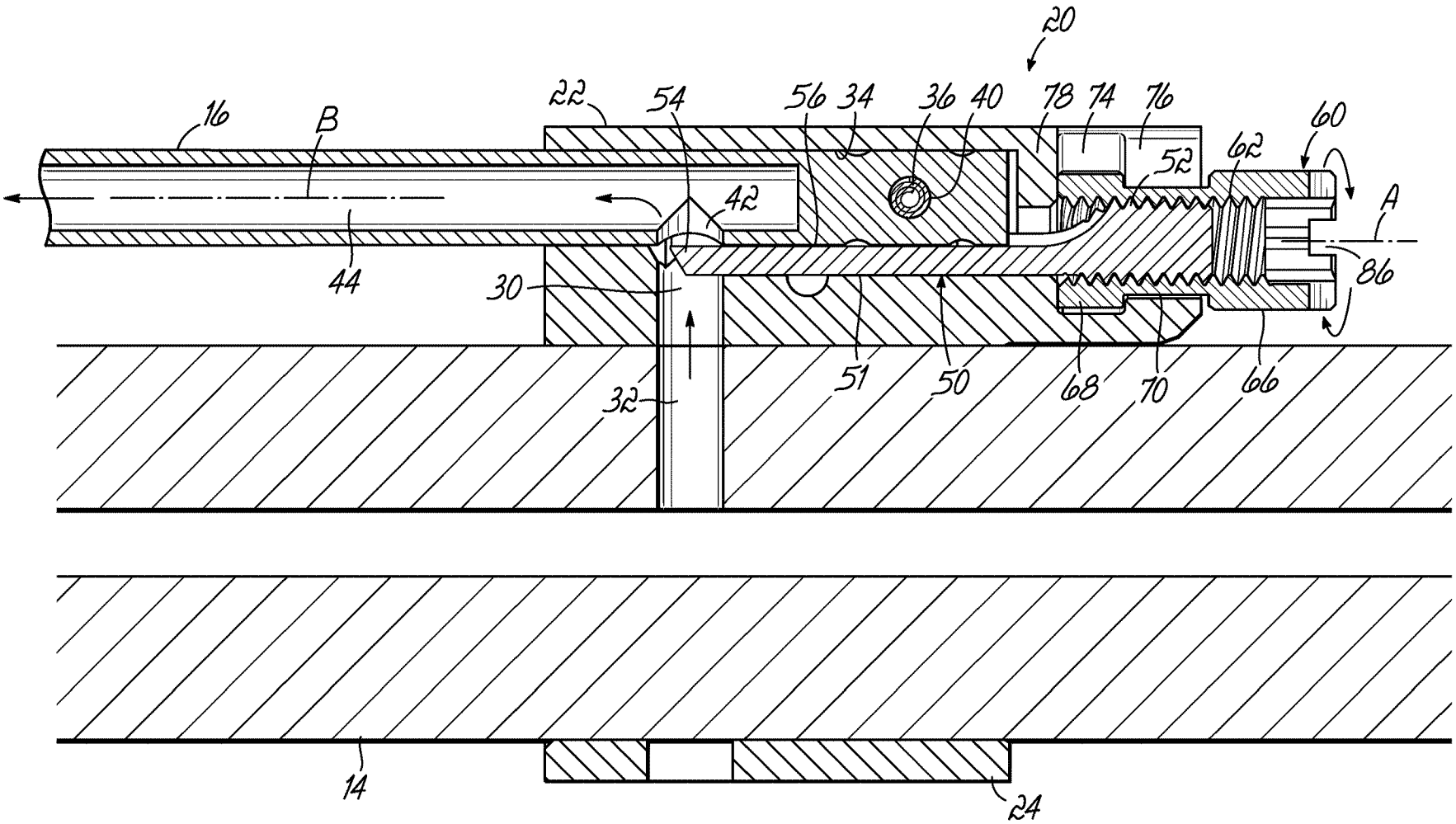
FIG. 5 is a view similar to FIG. 4 showing the valve in a partially open/partially closed position.
Figure 6:
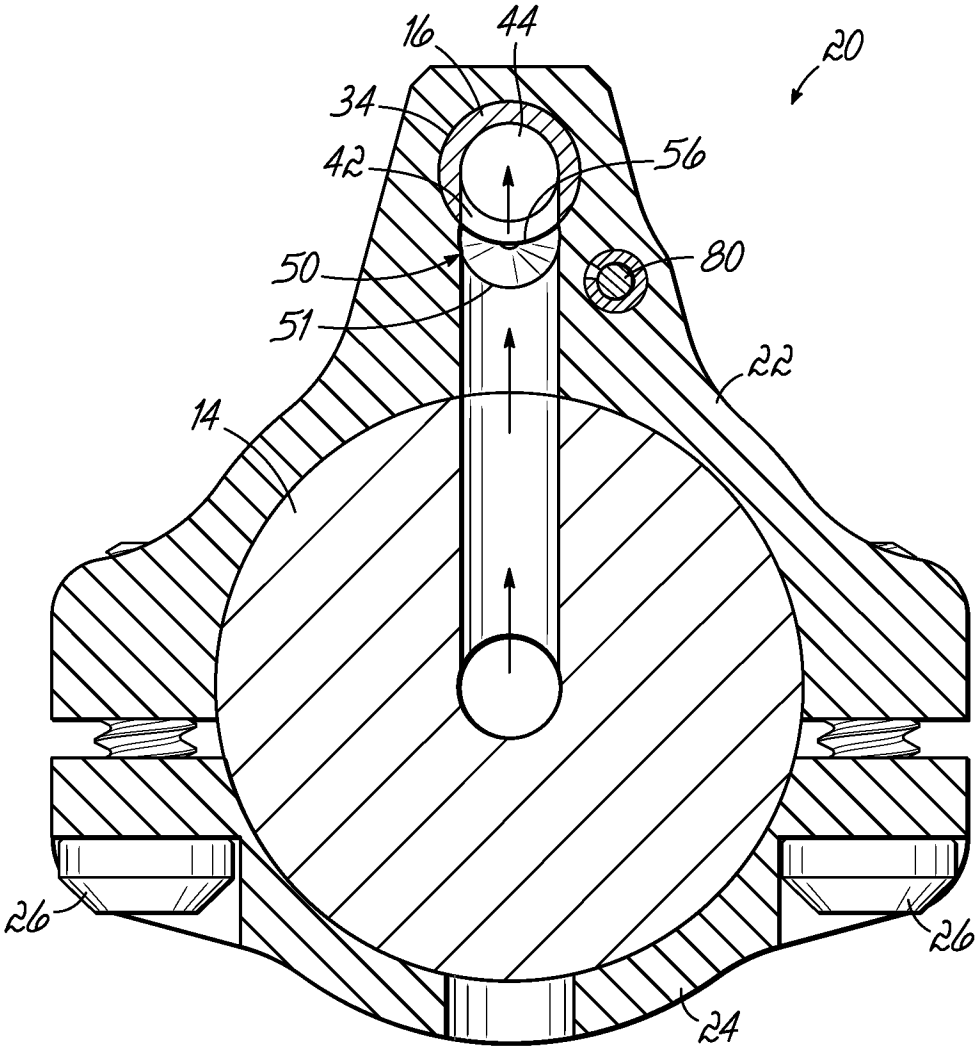
FIG. 6 is a cross-sectional view taken along line 6-6 in FIG. 5.
Figure 7:
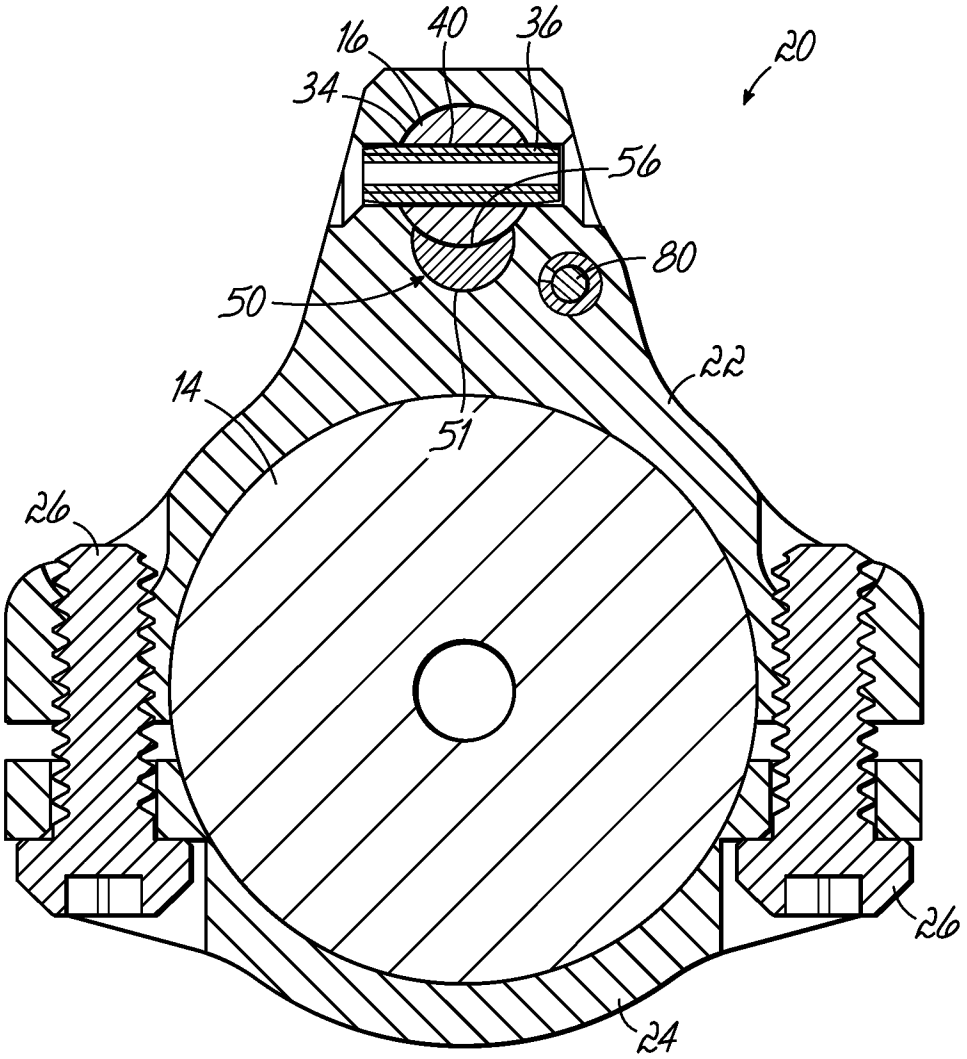
FIG. 7 is a cross-sectional view taken along line 7-7 in FIG. 5.

As can be seen in FIGS. 4 and 5, the axial position of a rearward end of the rearward portion 54 of the valve 50 controls the amount of gas passing from the first passageway 30 to the gas tube 16. By rotating the nut 60, the first passageway 30 can be completely opened (FIG. 4), partially opened (or partially closed) (FIG. 5), or completely opened (not shown).

Other means of transforming rotational movement of nut 60 into axial translation of valve 50 are contemplated, such as a cam pin and cam slot, worm gear, etc.

Referring still to FIGS. 4 and 5, it will be appreciated that the novel configuration of the valve 50 permits the axis of rotation A of the nut 60 and the longitudinal axis B of the gas tube 16 to be spaced apart by an amount less than one half of the sum of the outer diameter of the gas tube 16 and an outer diameter of the forward portion 52 of the valve 50, thus providing a compact configuration of adjustable gas block. If desired, a valve member could be configured with a rearward portion offset from the thread axis such that the valve member and gas tube are substantially coaxial.

Referring to FIGS. 3 and 6-8, upper housing 22 can further include a resilient detent 80 mounted in a recess 82 in upper housing 22 that cooperates with the nut 60 to provide positive engagement of the nut 60 at a plurality of rotational positions of the nut 60. More particularly, detent 80 can be a spring pin or lever that engages with notches 84 on rearward portion 68 of nut 60. Rotating nut 60 deflects spring pin or lever 80 out of one notch 84 and into the next successive notch 84. The recess 82 is sized to allow sufficient deflection of the shaft into and between notches 84 as the nut 60 rotates.

Other means of removably retaining the nut 60 in position are contemplated, such as a ball or plunger that is spring loaded inside a channel of the upper housing 22 that engages depressions in the nut 60.

The forward portion 66 of nut 60 can also include such serration, knurling, or notches 84 to assist a user in grasping and rotating nut 60 to adjust adjustable gas block 20. In addition, the forward end of the forward portion 66 of the nut 60 can include slots 86, such as a pair of at right angles, for use with a common or specialized tool to rotate nut 60.

The adjustable gas block of the present invention thus allows for a compact design that overcomes issues in current adjustable gas blocks. Firstly, the linear valve stem is nested into the gas tube allowing the height of the adjustable gas block to closely approximate the height of the standard nonadjustable gas block of the standard M4 carbine. This reduces bending in the gas tube and resultant stresses which can be common in many current adjustable gas block designs. Secondly, the valve nut sits in front of the gas tube which gives greater space for a larger part and thus more detent locations. This, in combination with a fine thread pitch mating the nut and stem, can easily double the detent resolution. Lastly, the valve nut and detent mechanism can be mounted externally to the gas manifold which prevents excessive carbon fouling and build up while also allowing easy access for cleaning.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. The invention resides in each individual feature described herein, alone, and in any and all combinations and subcombinations of any and all of those features. Accordingly, all suitable modifications and equivalents may be included and considered to fall within the scope of the invention, defined by the following claim or claims.

What is claimed is:

1. An adjustable gas block for a firearm, comprising:

a housing adapted to be attached to a barrel of the firearm, the housing having a first passageway adapted to be aligned with a gas port in a barrel of the firearm and a second passageway adapted to receive a gas tube of the firearm, such that a bore of the barrel, the gas port of the barrel, the first passageway, and the gas tube are in fluid communication, a valve member mounted in the housing for forward and rearward sliding movement and having a first portion and a second portion, the first portion having an upwardly facing surface having a radius of curvature that closely approximates a radius of curvature of an outer diameter of the gas tube, the second portion having threads, and a nut mounted to the housing for rotational movement and having threads mating with the threads on the second portion of the valve member, whereby rotating the nut in a first direction translates the valve member forwardly and rotating the nut in a second opposite direction translates the valve member rearwardly, the axial position of the first portion of the valve member controlling the amount of gas passing from the first passageway to the gas tube by completely opening, partially opening, or completely closing the first passageway.

2. The adjustable gas block of claim 1, further including a resilient detent carried by the housing that cooperates with the nut to provide positive engagement of the nut at a plurality of rotational positions of the nut.

3. The adjustable gas block of claim 1, wherein:

the nut includes a forward portion, a rearward portion, and a central portion, the central portion having an outer diameter less than an outer diameter of the rearward portion, and the housing has a recess forward of the first passageway, the recess having a forward shoulder and a rearward shoulder, the recess receiving the rearward portion of the nut, a rearward surface of the rearward portion of the nut abutting the rearward shoulder of the recess to prevent rearward translation of the nut, a forward surface of the rearward portion of the nut abutting the forward shoulder to prevent forward translation of the nut.

4. The adjustable gas block of claim 3, wherein the forward and rearward portions of the nut each include a plurality of longitudinally extending grooves circumferentially spaced therearound.

5. The adjustable gas block of claim 1, wherein an axis of rotation of the nut is positioned below a longitudinal axis of the gas tube.

6. The adjustable gas block of claim 5, wherein the axis of rotation of the nut and the longitudinal axis of the gas tube are spaced apart by an amount less than one half of the sum of the outer diameter of the gas tube and an outer diameter of the forward portion of the valve member.

7. A firearm, comprising:

an action, a barrel having a bore and a gas port, a gas tube for receiving gas from the bore via the gas port and directing the gas to the action to cycle the action, an adjustable gas block having a housing attachable to the barrel, the housing having a first passageway aligned with the gas port and a second passageway receiving the gas tube, such that the bore, the gas port, the first passageway, and the gas tube are in fluid communication, a valve member mounted in the housing for forward and rearward sliding movement and having a first portion and a second portion, the first portion having an upwardly facing surface having a radius of curvature that closely approximates a radius of curvature of an outer diameter of the gas tube, the second portion having threads, and a nut mounted to the upper housing for rotational movement and having threads mating with the threads on the second portion of the valve member, whereby rotating the nut in a first direction translates the valve member forwardly and rotating the nut in a second opposite direction translates the valve member rearwardly, the axial position of the first portion of the valve member controlling the amount of gas passing from the first passageway to the gas tube by completely opening, partially opening, or completely closing the first passageway.

8. The firearm of claim 7, further including a resilient detent carried by the housing that cooperates with the nut to provide positive engagement of the nut at a plurality of rotational positions of the nut.

9. The firearm of claim 7, wherein:

the nut includes a forward portion, a rearward portion, and a central portion, the central portion having an outer diameter less than an outer diameter of the rearward portion, and the housing has a recess forward of the first passageway, the recess having a forward shoulder and a rearward shoulder, the recess receiving the rearward portion of the nut, a rearward surface of the rearward portion of the nut abutting the rearward shoulder of the recess to prevent rearward translation of the nut, a forward surface of the rearward portion of the nut abutting the forward shoulder to prevent forward translation of the nut.

10. The firearm of claim 9, wherein the forward and rearward portions of the nut each include a plurality of longitudinally extending grooves circumferentially spaced therearound.

11. The firearm of claim 7, wherein an axis of rotation of the nut is positioned below a longitudinal axis of the gas tube.

12. The firearm of claim 11, wherein the axis of rotation of the nut and the longitudinal axis of the gas tube are spaced apart by an amount less than one half of the sum of the outer diameter of the gas tube and an outer diameter of the forward portion of the valve member.

13. An adjustable gas block for a firearm, comprising:

a housing adapted to be attached to a barrel of the firearm, the housing having a first passageway adapted to be aligned with a gas port in a barrel of the firearm and a second passageway adapted to receive a gas tube of the firearm, such that a bore of the barrel, the gas port of the barrel, the first passageway, and the gas tube are in fluid communication, a valve member mounted in the housing for forward and rearward sliding movement and having a first portion and a second portion, the second portion having threads, and a nut mounted to the housing for rotational movement and having threads mating with the threads on the second portion of the valve member, whereby rotating the nut in a first direction translates the valve member forwardly and rotating the nut in a second opposite direction translates the valve member rearwardly, the axial position of the first portion of the valve member controlling the amount of gas passing from the first passageway to the gas tube by completely opening, partially opening, or completely closing the first passageway, wherein the first portion of the valve member is configured such that an axis of rotation of the nut and a longitudinal axis of the gas tube are spaced apart by an amount less than one half of the sum of an outer diameter of the gas tube and an outer diameter of the forward portion of the valve member.

14. A firearm, comprising:

an action, a barrel having a bore and a gas port, a gas tube for receiving gas from the bore via the gas port and directing the gas to the action to cycle the action, an adjustable gas block having a housing attachable to the barrel, the housing having a first passageway aligned with the gas port and a second passageway receiving the gas tube, such that the bore, the gas port, the first passageway, and the gas tube are in fluid communication, a valve member mounted in the housing for forward and rearward sliding movement and having a first portion and a second portion, the second portion having threads, and a nut mounted to the housing for rotational movement and having threads mating with the threads on the second portion of the valve member, whereby rotating the nut in a first direction translates the valve member forwardly and rotating the nut in a second opposite direction translates the valve member rearwardly, the axial position of the first portion of the valve member controlling the amount of gas passing from the first passageway to the gas tube by completely opening, partially opening, or completely closing the first passageway, wherein the first portion of the valve member is configured such that an axis of rotation of the nut and a longitudinal axis of the gas tube are spaced apart by an amount less than one half of the sum of an outer diameter of the gas tube and an outer diameter of the second portion of the valve member.

* * * * *